US009926059B2

(12) United States Patent
Kokkila

(10) Patent No.: US 9,926,059 B2
(45) Date of Patent: Mar. 27, 2018

(54) SHIP PROPULSION ARRANGEMENT

(71) Applicant: ABB Oy, Helsinki (FI)

(72) Inventor: Kimmo Kokkila, Helsinki (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 15/449,620

(22) Filed: Mar. 3, 2017

(65) Prior Publication Data

US 2017/0174302 A1 Jun. 22, 2017

Related U.S. Application Data

(63) Continuation of application No. PCT/FI2015/050500, filed on Jul. 10, 2015.

(30) Foreign Application Priority Data

Sep. 3, 2014 (EP) ..... 14183397

(51) Int. Cl.

| | |
|---|---|
| ***B63H 5/125*** | (2006.01) |
| ***B63H 21/17*** | (2006.01) |
| ***B63H 25/42*** | (2006.01) |
| ***B63H 21/36*** | (2006.01) |
| *B63H 5/07* | (2006.01) |

(52) U.S. Cl.

CPC ..... *B63H 5/125* (2013.01); *B63H 21/17* (2013.01); *B63H 21/36* (2013.01); *B63H 25/42* (2013.01); *B63B 2755/00* (2013.01); *B63H 2005/075* (2013.01); *B63H 2005/1258* (2013.01)

(58) Field of Classification Search

CPC ..... B63H 5/125; B63H 21/17

USPC ..... 440/6, 53

See application file for complete search history.

(56) References Cited

U.S. PATENT DOCUMENTS

| | | | | |
|---|---|---|---|---|
| 2,549,481 A * | 4/1951 | Kiekhaefer | B63H 20/10 | 188/83 |
| 2,714,866 A | 8/1955 | Pleuger et al. | | |
| 3,688,733 A * | 9/1972 | Blanchard | B63H 20/10 | 248/642 |
| 4,746,311 A * | 5/1988 | Kraus | B63H 20/007 | 114/144 E |
| 4,840,592 A * | 6/1989 | Anderson | B63B 35/7943 | 114/66 |

(Continued)

FOREIGN PATENT DOCUMENTS

JP 2005047305 A 2/2005

OTHER PUBLICATIONS

International Search Report and Written Opinion, PCT/FI2015/050500, ABB Oy, dated Sep. 25, 2015, 9 pages.

(Continued)

*Primary Examiner* — Lars A Olson
*Assistant Examiner* — Jovon E Hayes
(74) *Attorney, Agent, or Firm* — Tast Stettinius & Hollister LLP

(57) ABSTRACT

A ship comprising a hull having a transom and a bottom, and an azimuthing propulsion unit arranged to the bottom of the ship hull, which azimuthing propulsion unit comprises a propeller. The azimuthing propulsion unit comprises an exposed operation mode in which the propeller sets, behind the transom of the hull and that the azimuthing propulsion unit is rotatable and comprises a protected position mode in which the azimuthing propulsion unit stays below the hull of the ship.

24 Claims, 1 Drawing Sheet

(56) References Cited

U.S. PATENT DOCUMENTS

Figure 1:
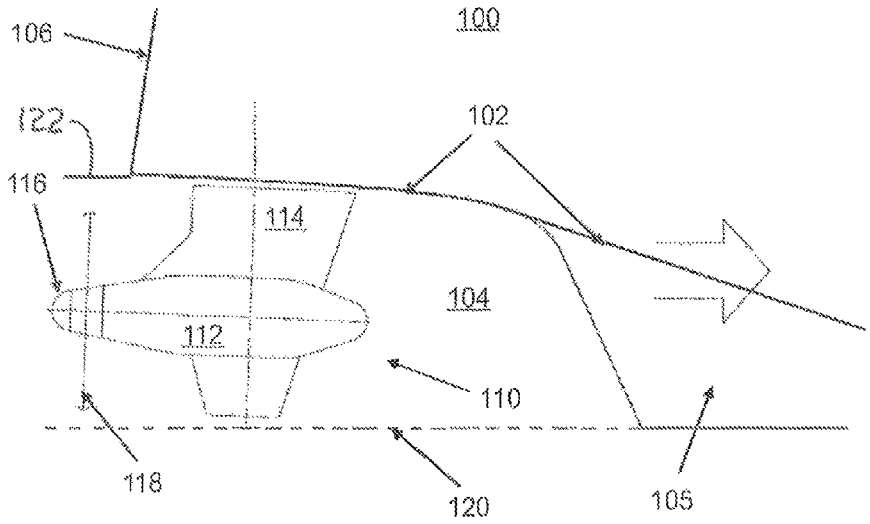

| | | | | |
|---|---|---|---|---|
| 5,207,604 | A * | 5/1993 | McMillin | B63H 21/265 114/144 R |
| 5,403,216 | A | 4/1995 | Salmi et al. | |
| 6,431,928 | B1 * | 8/2002 | Aarnivuo | B63H 5/125 114/144 RE |
| 6,688,927 | B2 * | 2/2004 | Aarnivuo | B63H 5/125 114/144 RE |
| 7,207,852 | B2 * | 4/2007 | Myers | B63H 21/20 310/87 |
| 7,662,005 | B2 * | 2/2010 | Provost | B63H 20/08 440/53 |
| 2017/0174302 | A1 * | 6/2017 | Kokkila | B63H 5/125 |

OTHER PUBLICATIONS

International Preliminary Report on Patentability, PCT/FI2015/050500, ABB Oy, dated Dec. 8, 2016, 8 pages.

* cited by examiner

SHIP PROPULSION ARRANGEMENT

FIELD

The present invention relates to a propulsion arrangement of a ship.

BACKGROUND

In current propulsion arrangements for there is some inefficiency due to the positioning of the propulsion arrangement. Often the propeller cannot be optimised for efficiency due to the propeller in pressure pulses and noise to ship hull. An improved solution is thus called for.

SUMMARY

An object of the present mention is provide ship having an azimuthing propulsion unit so as to alleviate the above disadvantages. The object of the invention is achieved with a ship, which is defined in the independent claim. Some embodiments are disclosed in the dependent claims.

In an aspect, there is provided a ship comprising a hull having a rear end and a bottom, and an azimuthing propulsion unit arranged to the bottom of the ship hull, which azimuthing propulsion unit comprises a propeller. The azimuthing propulsion unit comprises an exposed position mode in which the propeller sets, behind the rear end of the hull. In an embodiment, the rear end of the ship refers to the transom of the ship hull.

In an embodiment the azimuthing propulsion unit is rotatable and comprises a protected position mode in which the azimuthing propulsion unit stays below the hull of the ship. Thereby the ship can be classified as small a possible and may have the opportunity to enter a greater number of harbours.

In an embodiment the propeller is designed for providing a maximal efficiency when operated in a pushing operation mode in the exposed position mode.

In an embodiment the propeller design optimised for pushing operation mode in the exposed position mode by applying at least one of a pitch distribution, a skew angle, a propeller diameter, number of blades, a blade area ratio, the propeller rotational speed and a propeller hubcap shape as design parameter.

In an embodiment the propeller is designed to enable operation in protected position and pulling operation mode with limited power and ship speed.

In an embodiment the rotation direction of the propeller can be reversed so that the propeller is operated in a pulling operation mode in the exposed position mode and/or in a pushing operation mode in the protected position mode.

In an embodiment at least one of the power and the turning angle are limited in the protected position mode of the azimuthing propulsion unit.

In an embodiment the propeller comprises three or four blades, which provides the maximum power output.

In an embodiment the azimuthing propulsion unit comprises a pod, a propulsion motor positioned inside the pod, a substantially horizontal drive shaft drivingly connected to the propulsion motor and the propeller, and a strut rigidly attached to the pod, the ship further comprising a bearing unit for supporting the strut and showing rotation of the strut with respect to the ship hull.

In an embodiment the shape of the pod is at least primarily optimised for pushing operation and exposed position mode.

In an embodiment the ship comprises a cover having an activated mode in which the cover sets above the propeller of the azimuthing propulsion unit for preventing passengers to fall onto the propeller, which activated mode of the cover is applied when the azimuthing propulsion unit is operated in the exposed position mode. In the pushing mode, that is the normal cruising mode, it is not a decisive factor that the ship dimensions may be temporarily extended. The cover may be arranged to the transom of the ship.

In an embodiment the cover has a non-activated mode in which mode the cover does not extend the hull's dimensions, which non-activated mode is applied when the azimuthing propulsion unit is operated in the protected position mode. Upon non-activation of the cover, it may be lifted or turned against the transom of the ship.

In an embodiment the cover is automatically switched between the activated and non-activated modes when the azimuthing propulsion unit is operated in the exposed and protected position modes, respectively.

In an embodiment the rear end of the hull comprises a transom of the ship.

DRAWINGS

Figure 2:
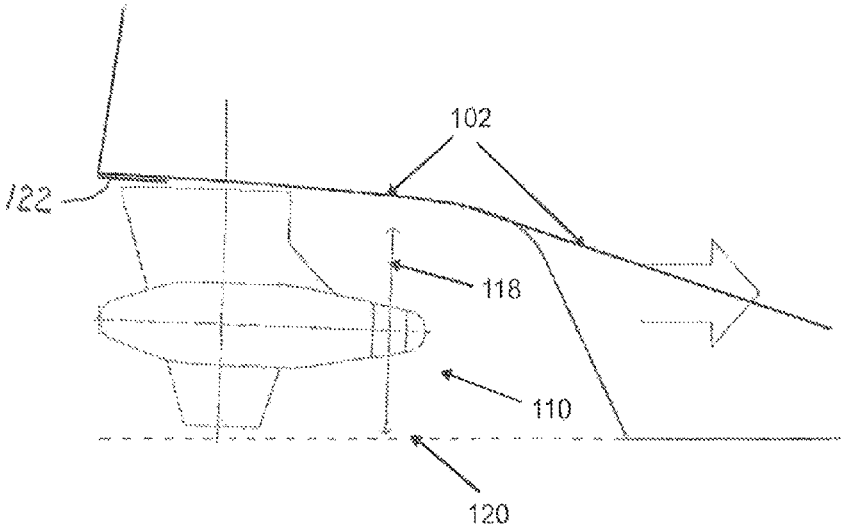

In the following, the invention will be described in greater detail by means of some embodiments with reference to the accompanying drawings, in which FIG. 1 shows an embodiment of a slip having an azimuthing propulsion unit operated in an exposed position mode;

FIG. 2 shows the propulsion unit of FIG. 1 operated a protected position mode.

DETAILED DESCRIPTION

The embodiments relate to a ship having an azimuthing propulsion unit. The embodiments especially relate to the positioning of the azimuthing propulsion unit in the ship. One such embodiment is illustrated in FIG. 1.

There is provided a ship having a hull 100. Only the rear bottom end of the ship being relevant for explaining the invention is shown. The ship hull comprises a bottom 102 which approaches and meets the ship base line 120 in a low-gradient way. To the bottom 102 there may be arranged a skeg 105 which typically has a width of about one to few meters that is the skeg does not extend the whole width of the bottom. There is formed a space 104 below the bottom for receiving the azimuthing propulsion unit. The azimuthing propulsion unit is preferably located behind the skeg(s) as shown in FIGS. 1 and 2. Alternatively, if the ship has two or more azimuthing propulsion units, some of them may be located at least partly adjacent to the skeg(s) on side of it. Thus, in the forward direction of the ship illustrated by the arrow, the propulsion unit 110 finds protection from the bottom 102 of the ship. The ship also comprises a transom 106, which is the end surface of the ship hull.

The azimuthing propulsion unit 110 comprises a pod 112, which is fixedly arranged to a strut 114. The strut 114 is arranged rotationally by a bearing/swivel unit to the bottom 102A of the ship.

The pod 12 houses a propulsion motor being an electric motor for rotating a propeller 118 fixed to a hub 116 at the end of the pod 112. A shaft rotated by the electric motor is the same shaft that rotates the propeller or at least coaxial to it.

The azimuthing propulsion unit 110 has two principal operation positions, which are illustrated in FIGS. 1 and 2.

In FIG. 1, the propulsion unit is in an exposed position mode, in which the propeller is exposed being exterior of the outer dimensions of the ship hull when seen vertically from above the ship. FIG. 2 shows a protected position mode of the propulsion unit 110, in which the propeller resides within the outer dimensions of the ship hull that is the propeller resides all the time under the ship hull.

As FIG. 1 shows, the propeller 118 sets in exposed position mode behind the transom 106 of the ship hull 100. That is, the longitudinal direction of to the blades of the propeller 118 is behind the furthest point of the transom of the ship hull. The longitudinal direction of the blades of the propeller refers here to the perpendicular direction when compared to the rotation axis of the propeller.

FIG. 2 shows the propulsion arrangement of FIG. 1 a protected position mode in a 180 degrees rotated position. It can be seen that the whole propulsion unit 110, and specifically the propeller, is situated within the ship hull dimensions. In longitudinal direction the propulsion unit is situated in front of the most rear point of the hull. Also in the direction of the ship width, the propulsion unit fits below the bottom of the ship. This can be achieved by dimensioning of the propulsion unit and/or limiting the rotation of the propulsion unit when in the protected position mode.

In an embodiment, the position of the propulsion arrangement show in FIG. 1 is applied when the propeller is in a pushing mode. This mode may be applied during a normal cruise mode of the ship. In an embodiment, the propeller 118 may be operated also in a pulling mode in the position of FIG. 1. This may be applied in harbours, for instance, if for some reason the protected operation mode of FIG. 2 is not used. However, preferably the propeller is optimized for the pushing operation in the exposed mode.

The position of the propulsion unit shown in FIG. 2 may be applied in a pulling mode of the ship. The pulling mode may be used in harbours, for instance. In this mode the maximum power may be limited. Also the steering angles may be limited so that the propulsion unit does not get out from ship hull's dimensions. In this way the classification of the ship can be kept as short, whereby the ship is allowed to enter smaller harbours. In an embodiment, the propeller may also be used in a pushing mode in the protected position mode, although such use may be non-optimal and be applied only occasionally.

Although the figures show only one propeller unit, the invention can also be applied in a situation of multiple propellers.

Closable fall covers 122 can be installed to propeller location(s) if there is fear that passengers can fall directly to propellers. In an embodiment, the cover 122 is installed to the transom. In an embodiment, the cover 122 is lowerable/liftable. In another embodiment, the cover 122 can be (de)activated telescopically.

The cover 122 may thus have two operation modes, an activated mode and a non-activated mode. The activated mode, illustrated in FIG. 1, is applied when the propeller resides outside the dimensions of the ship hull, that is, in the exposed mode. The non-activated mode, illustrated in FIG. 2, is applied when the azimuthing propeller unit is operated in the protected position mode. The transition between the activated and non-activated modes of the cover 122 may occur automatically when the operation mode of the propulsion unit is changed.

Thus, in the invention, the propeller is not located, at all times of the operation, under the ship hull but behind the transom, where there is no ship hull above the propeller anymore. In this way, the propeller design can be optimized for highest efficiency for pushing operation and exposed position mode.

In prior solutions, when the propeller has been positioned below the ship hull, the hull has negatively affected the propeller efficiency. That is, the propeller operation produces pressure pulses, which cause vibration and noise on the hull. In prior art, often the number of blades has been increased to 5, for instance, to get the pressure pulses lower than what would optimal from the efficiency point of view. In the embodiments of the invention, the number of blades can be reduced to four or even three to get maximal efficiency out of the propulsion system. In addition, the propeller tip loading can be increased. The positioning of the propeller under the hull has also put limitations on the propeller design.

By way of the invention, when the propeller sets in the pushing mode behind the transom, the pressure pulses are no problem anymore, and the operation can be optimized from the efficiency point of view.

Propeller design is optimised mostly for pushing/exposed mode considering, for example, one or more of the following design factors: pitch distribution, skew angle, propeller diameter, blade number, blade area ratio, propeller/rotational speed (RPM) and propeller hubcap shape, but propeller design considers also that the operation in pulling/protected mode would be possible/reasonable with limited power and ship speed. By way of an example, the diameter of the propeller may be increased. By way of another example, the pitch distribution may be selected such that the propeller does not need to lighten as much as the traditional propellers towards the tip of the propeller.

In addition to the propeller design, pod housing shape may be mostly optimised for pushing/exposed mode as well, but compromised to enable continual operation also in pulling/exposed mode with limited power and ship speed.

By way of the invention, the propulsion efficiency of a typical pod propeller can be estimated to increase by about 5% to 8%, which gives substantial savings in the fuel costs.

In the embodiments, the pulling mode usable in harbours is also very advantageous. By having the azimuthing propulsion unit within the ship dimensions the ship's total length in harbour operation can be minimized. In addition, propellers are safely inside the ship main dimension to minimize the risk for propeller collision to other objects.

It will be obvious to a person skilled in the art that, as the technology advances, the inventive concept can be implemented in various ways. The invention and its embodiments are not limited to the examples described above but may vary within the scope of the claims.

The invention claimed is:

1. A ship comprising a hull having a rear end and a bottom, and an azimuthing propulsion unit arranged to the bottom of the ship hull, which azimuthing propulsion unit comprises a propulsion motor and a propeller driven by the propulsion motor, wherein the azimuthing propulsion unit comprises an exposed position mode in which the propulsion motor is disposed underneath the hull and the propeller sets behind the rear end of the hull and that the azimuthing propulsion unit is rotatable and comprises a protected position mode in which the azimuthing propulsion unit is disposed underneath the hull of the ship.

2. The ship according to claim 1, wherein the propeller is designed for providing a maximal efficiency when operated in a pushing operation mode in the exposed position mode.

3. The ship according to claim 1, wherein a propeller design is optimised for pushing operation mode in the exposed position mode by applying at least one of a pitch distribution, a skew angle, a propeller diameter, number of blades, a blade area ratio, a propeller rotational speed and a propeller hubcap shape as design parameter.

4. The ship according to claim 1, wherein the propeller is designed to enable operation in protected position and pulling operation mode with limited power and ship speed.

5. The ship according to claim 1, wherein a rotation direction of the propeller can be reversed so that the propeller is operated in a pulling operation mode in the exposed position mode and/or in a pushing operation mode in the protected position mode.

6. The ship according to claim 1, wherein at least one of a power and a turning angle are limited in the protected position mode of the azimuthing propulsion unit.

7. The ship according to claim 1, wherein the propeller comprises three or four blades.

8. The ship according to claim 1, wherein the azimuthing propulsion unit comprises a pod, wherein the propulsion motor is positioned inside the pod, and wherein the azimuthing propulsion unit further comprises a substantially horizontal drive shaft drivingly connected to the propulsion motor and the propeller, and a strut rigidly attached to the pod, the ship further comprising a bearing unit for supporting the strut and allowing rotation of the strut with respect to the ship hull.

9. The ship according to claim 1, wherein the propulsion motor is positioned in a pod; and wherein the shape of the pod is optimised for pushing operation and exposed position mode.

10. The ship according to claim 1, wherein the ship comprises a cover having an activated mode in which the cover sets above the propeller of the azimuthing propulsion unit for preventing passengers to fall onto the propeller, which activated mode of the cover is applied when the azimuthing propulsion unit is operated in the exposed position mode.

11. The ship according to claim 10, wherein the cover has a non-activated mode in which mode the cover does not extend the hull's dimensions, which non-activated mode is applied when the azimuthing propulsion unit is operated in the protected position mode.

12. The ship according to claim 11, wherein the cover is automatically switched between the activated and non-activated modes when the azimuthing propulsion unit is operated in the exposed and protected position modes, respectively.

13. The ship according to claim 1, wherein the rear end of the hull comprises a transom of the ship.

14. The ship according to claim 2, wherein the propeller design is optimised for pushing operation mode in the exposed position mode by applying at least one of a pitch distribution, a skew angle, a propeller diameter, number of blades, a blade area ratio, a propeller rotational speed and a propeller hubcap shape as design parameter; and wherein the propeller is designed to enable operation in protected position and pulling operation mode with limited power and ship speed.

15. The ship according to claim 4, wherein the azimuthing propulsion unit comprises a pod, wherein the propulsion motor is positioned inside the pod, and wherein the azimuthing propulsion unit further comprises a substantially horizontal drive shaft drivingly connected to the propulsion motor and the propeller, and a strut rigidly attached to the pod, the ship further comprising a bearing unit for supporting the strut and allowing rotation of the strut with respect to the ship hull.

16. The ship according to claim 4, wherein the shape of the pod is optimised for pushing operation and exposed position mode.

17. The ship according to claim 1, wherein the ship comprises a cover having an activated mode in which the cover sets above the propeller of the azimuthing propulsion unit for preventing passengers to fall onto the propeller, which activated mode of the cover is applied when the azimuthing propulsion unit is operated in the exposed position mode;

wherein the cover has a non-activated mode in which mode the cover does not extend the hull's dimensions, which non-activated mode is applied when the azimuthing propulsion unit is operated in the protected position mode; and wherein the cover is automatically switched between the activated and non-activated modes when the azimuthing propulsion unit is operated in the exposed and protected position modes, respectively.

18. The ship according to claim 17, wherein the rear end of the hull comprises a transom of the ship.

19. The ship according to claim 1, wherein at least one of a power and a turning angle are limited in the protected position mode of the azimuthing propulsion unit;

wherein the propeller comprises three or four blades;

wherein the azimuthing propulsion unit comprises a pod, wherein the propulsion motor is positioned inside the pod, and wherein the azimuthing propulsion unit further comprises a substantially horizontal drive shaft drivingly connected to the propulsion motor and the propeller, and a strut rigidly attached to the pod, the ship further comprising a bearing unit for supporting the strut and allowing rotation of the strut with respect to the ship hull; and wherein the shape of the pod is optimised for pushing operation and exposed position mode.

20. The ship according to claim 19, wherein a rotation direction of the propeller can be reversed so that the propeller is operated in a pulling operation mode in the exposed position mode and/or in a pushing operation mode in the protected position mode;

wherein at least one of the power and the turning angle are limited in the protected position mode of the azimuthing propulsion unit; and wherein the rear end of the hull comprises a transom of the ship.

21. The ship of claim 1, wherein the hull has a bottom that approaches and meets a ship base line; and wherein the propulsion motor is disposed at a higher elevation than the base line.

22. The ship of claim 1, wherein the hull has a bottom that approaches and meets a ship base line; and wherein the propeller is disposed at a higher elevation than the base line.

23. The ship of claim 1, wherein the hull has a bottom that approaches and meets a ship base line; the ship further including a skeg, wherein the azimuthing propulsion unit is disposed aft of the skeg.

24. The ship of claim 23, wherein the azimuthing propulsion unit is disposed at a higher elevation than the base line.

* * * * *